US005881620A

United States Patent [19]

Smithwick, Jr. et al.

[11] Patent Number: 5,881,620

[45] **Date of Patent: *Mar. 16, 1999**

[54] APPARATUS FOR EJECTING CUT CORRUGATED BOARD FROM A CUTTING DIE

[75] Inventors: James M. Smithwick, Jr., Holly Springs; Jack R. Simpson, Raleigh; Jeffrey Geer, Apex, all of N.C.

[73] Assignee: Container Graphics Corporation, Cary, N.C.

[ * ] Notice: The portion of the term of this patent subsequent to Mar. 8, 2015, has been disclaimed.

[21] Appl. No.: 733,030

[22] Filed: Oct. 16, 1996

Related U.S. Application Data

[63] Continuation-in-part of Ser. No. 400,547, Mar. 8, 1995, Pat. No. 5,636,559, which is a continuation-in-part of Ser. No. 117,533, Oct. 7, 1993, abandoned.

[51] Int. Cl.[6] ..... B26D 7/18

[52] U.S. Cl. ..... 83/116; 83/128; 83/139; 493/82; 493/342; 493/472

[58] Field of Search ..... 83/116–118, 123–126, 83/128, 138–140, 658, 659, 669, 670, 142, 143, 145; 493/82, 83, 342, 373, 472

[56] References Cited

U.S. PATENT DOCUMENTS

| | | | |
|---|---|---|---|
| 3,046,824 | 7/1962 | Mohr | 83/658 |
| 3,167,985 | 2/1965 | Madsen | 83/139 |
| 3,282,142 | 11/1966 | Sauer | 83/659 |
| 3,827,322 | 8/1974 | Saunders et al. | 83/128 |
| 4,075,918 | 2/1978 | Sauer | 83/659 |
| 4,499,802 | 2/1985 | Simpson | 83/117 |
| 4,522,095 | 6/1985 | Saunders et al. | 83/123 X |
| 5,111,725 | 5/1992 | Simpson et al. | 83/117 |
| 5,636,559 | 6/1997 | Smithwick, Jr. et al. | 83/116 |

*Primary Examiner*—Clark F. Dexter

*Attorney, Agent, or Firm*—Rhodes, Coats, & Bennett, LLP

[57] ABSTRACT

An elongated rubber ejector is mounted to a die board that forms a part of a cutting die and the ejector functions to engage cut corrugated board and eject the same from the cutting die. The rubber ejector includes upper and lower faces or surfaces with each face including a series of spaced apart raised lugs with a series of spaced apart voids or relief areas disposed between the lugs. Lugs and relief areas formed on one face are staggered with respect to the lugs and relief areas formed on the other face. In practice, the lugs are compressed during a die cutting operation. Once the corrugated board has been cut and the die board and an opposed anvil have been moved apart, the lugs and the ejector expand and in the process the rubber ejector engages the cut corrugated board and ejects the same from the cutting die.

4 Claims, 12 Drawing Sheets

APPARATUS FOR EJECTING CUT CORRUGATED BOARD FROM A CUTTING DIE

REFERENCE TO RELATED APPLICATIONS

This is a continuation-in-part of U.S. patent application Ser. No. 08/400,547, filed Mar. 8, 1995, now U.S. Pat. No. 5,636,559, which was itself a continuation-in-part of U.S. patent application Ser. No. 08/117,533, filed Oct. 7, 1993, now abandoned.

FIELD OF THE INVENTION

The present invention relates to die cutting assemblies for corrugated board and more particularly to a rubber ejector adapted to be mounted to a die board for ejecting cut corrugated board from a die board.

BACKGROUND OF THE INVENTION

Corrugated board is typically cut by a cutting die including a die board having one or more cutting rules secured thereon and some means to eject cut corrugated board from the die board after cutting. Typically, it has been common to mount a relatively hard block shaped rubber ejector at certain points along the cutting rule for the purpose of ejecting cut corrugated board. In the cutting and ejection process, the cutting die and an opposed support or anvil are moved together, causing the cutting rules to cut the sandwiched corrugated board. During this process, the block shaped rubber ejectors are compressed as they partly lie above the surface of the cutting rules. Once the corrugated board has been cut, the cutting die is separated from the opposed support or anvil and in this process the hard block shaped rubber ejectors expand to their original shape. As the ejectors expand and move back past the cutting edge of the cutting rules, they eject or push the cut corrugated product from the cutting die.

There are a number of drawbacks and disadvantages to these hard block shaped rubber ejectors. First and most importantly, because of the hardness and overall design of the ejectors, they tend to crush certain flutes of the cut corrugated product during the cutting operation. Since the cut corrugated board is to be utilized to form corrugated boxes and interpack panels, the crushing of the flutes seriously effects and reduces the compression strength of the resulting corrugated container or interpack panel. Consequently, the stacking strength of a box or interpack panel is seriously impaired. Besides actually reducing the structural strength of the corrugated board, the crushing of flutes results in damage to the appearance and aesthetics of the cut corrugated board.

In addition, because of the hardness and overall design of these block shaped rubber ejectors, a relatively large force or tonnage is required to operate cutting dies containing such ejectors.

Finally, because of the nature of the hard block shaped rubber ejectors and the difficulty of properly mounting and adjusting the same on the die board, it is well-known and appreciated that the make-ready or setup time for cutting dies having these rubber ejectors mounted thereon is substantial. This obviously cuts into production time and in the end results in substantial costs.

SUMMARY AND OBJECTS OF THE INVENTION

The present invention relates to a rubber ejector for a corrugated board cutting die that is designed to overcome the drawbacks and disadvantages of conventional rubber ejectors. More particularly, the rubber ejector of the present invention is designed to eliminate or at least substantially reduce the crushing of the flutes forming a part of the corrugated board panels being cut by the cutting die having the rubber ejector incorporated therein. In addition, the rubber ejectors of the present invention are such that the overall pressure and force (commonly referred to as tonnage) required to operate a cutting die is reduced and so is the time to make-ready or set up the cutting die for operation.

The ejector of the present invention includes upper and lower faces or surfaces. The lower face is designed to rest adjacent a die board and the upper opposed face faces away from the die board. Formed along both the upper and lower faces are a series of spaced apart raised lugs. Formed between respective lugs on both the upper and bottom faces is a series of spaced apart voids or relief areas. In one embodiment disclosed herein, the raised lugs and relief areas on an upper face are staggered with respect to the raised lugs and relief areas on the bottom or lower face.

In one embodiment of the present invention, the ejector is of a rubber composition and is mounted adjacent one or more cutting rules in a die board of a cutting die. The spaced apart lugs formed on the upper or exposed face of the rubber ejector project away from the die board and towards the corrugated board passing between the die board and an opposed anvil or support plate. In a no load situation, the upper or outer portions of the lugs formed on the upper face project just past the cutting edge of the cutting rules. In a fully extended cutting state, the lugs are compressed and generally the compression of the lugs results in the rubber comprising the ejector being displaced into adjacent relief areas formed in the ejector. The rubber ejector is specifically designed and formed such that in the compressed state there is insufficient force being applied against the adjacent corrugated board to crush the flutes. Once the die board has been separated from the opposed anvil or support, the exposed lugs associated with the upper surface of the ejector is allowed to expand and during expansion they engage the cut corrugated product and essentially eject the same from the cutting die.

It is therefore an object of the present invention to provide an ejector for ejecting cut corrugated products from a cutting die that eliminates or substantially reduces flute crushing.

Another object of the present invention is to provide an ejector for ejecting cut corrugated board from a die board that is easy to install and adjust and consequently reduces setup or make-ready time.

Still a further object of the present invention resides in an ejector design for a cutting die that reduces the amount of pressure or force required to effectuate cutting and ejection.

A further object of the present invention is to provide an ejector for a die board that improves the overall operating efficiency of the cutting die and generally contributes to an increased life for the cutting die.

Other objects and advantages of the present invention will become apparent and obvious from a study of the following description and the accompanying drawings which are merely illustrative of such invention.

DETAILED DESCRIPTION OF THE INVENTION

Figure 1:
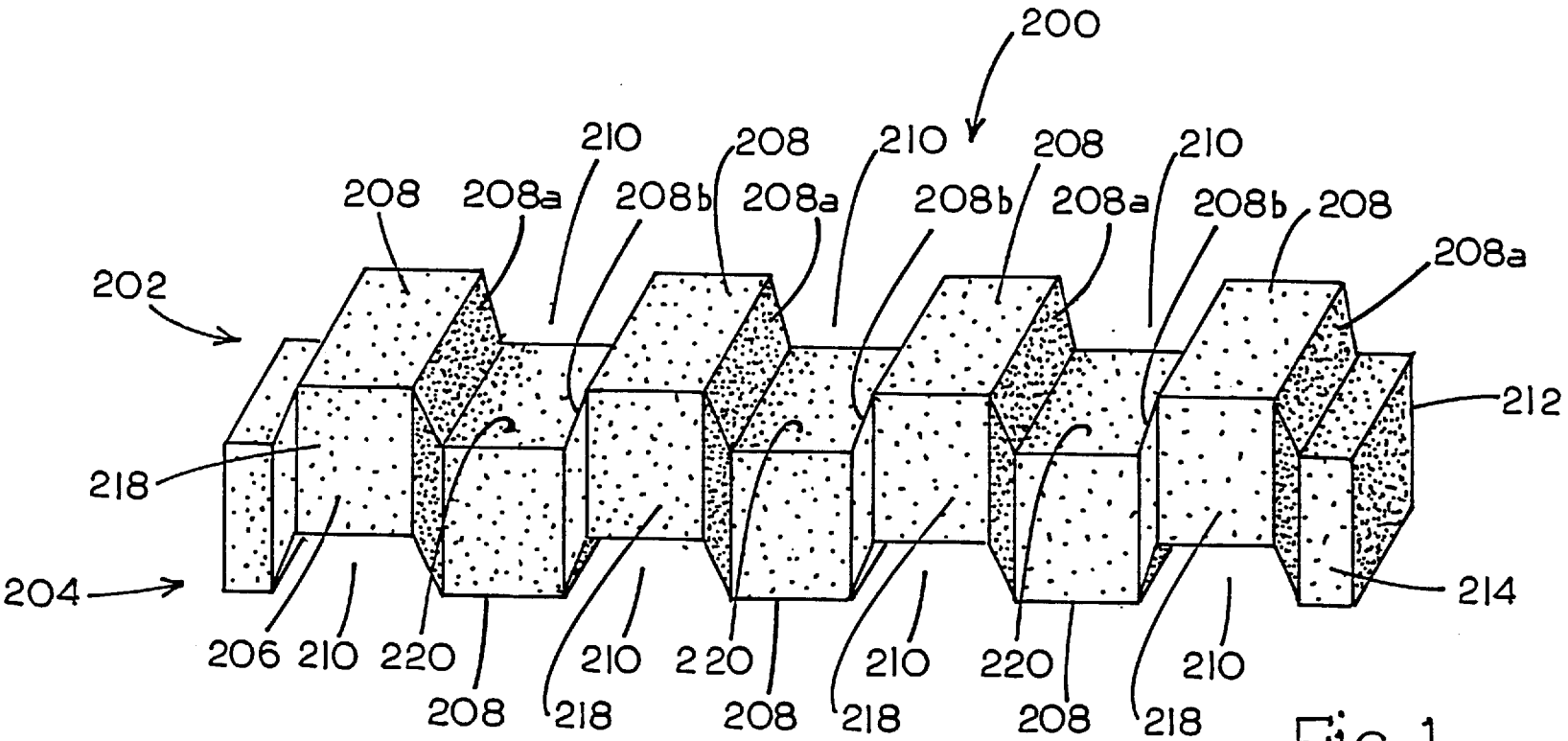
FIG. 1 is a perspective view of an ejector strip of the present invention.
Figure 2:
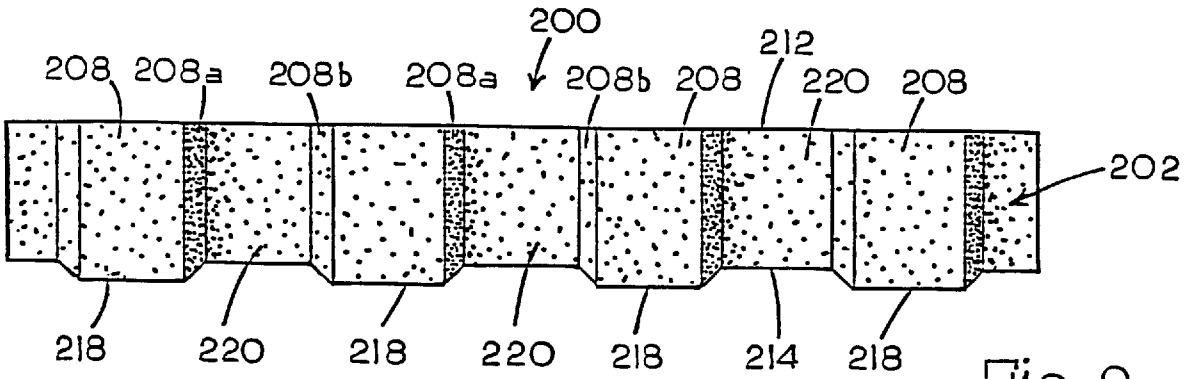
FIG. 2 is a top plan view of the ejector strip.
Figure 3:
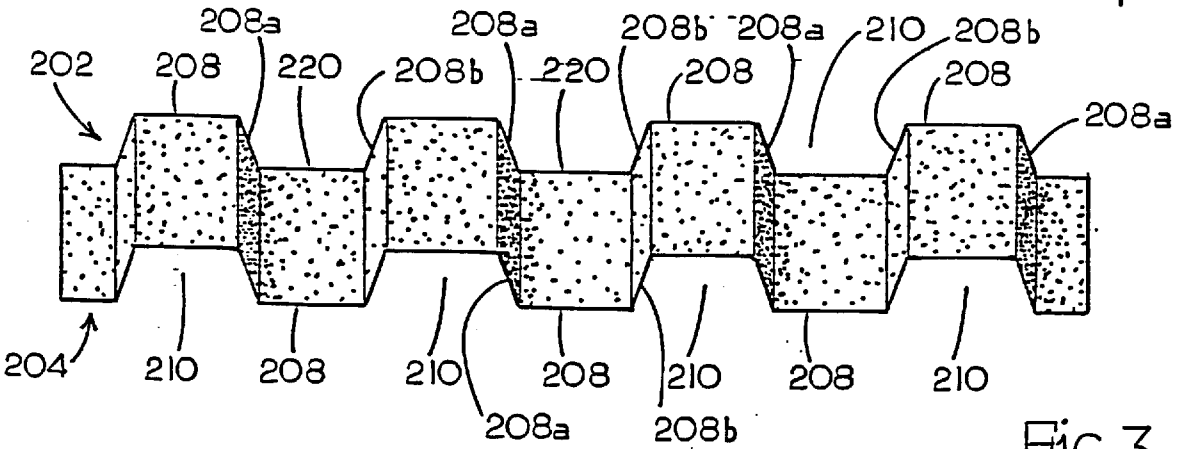
FIG. 3 is a side elevational view of the ejector strip.
Figure 4:
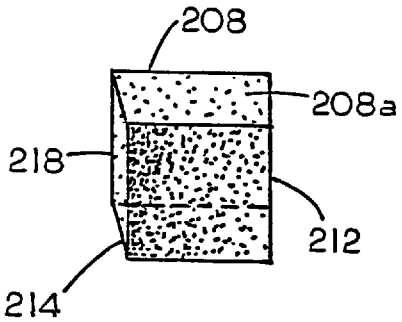
FIG. 4 is an end elevational view of the ejector strip.

With further reference to the drawings, particularly FIGS. 1–4, the ejector or ejector strip of the present invention is shown therein and indicated generally by the numeral 200. Viewing ejector 200 in more detail, the ejector in the embodiment disclosed, is of a rubber construction and includes an upper face or surface indicated generally by the numeral 202. Formed on the opposite side of the ejector 200 is a lower face or surface 204. Formed intermediately between the upper and lower faces 202 and 204 is a central body or web 206.

Upper face 202 includes a series of longitudinally spaced raised lugs 208. Formed between the respective lugs 208 is a series of spaced apart voids or relief areas 210. Likewise, formed on the lower face 204 is also a series of raised lugs 208 and a series of voids or relief areas 210 disposed between the lugs.

Rubber ejector 200 also includes a pair of sides 212 and 214. Side 214 includes a series of spaced apart protrusions 218 that project outwardly from the side 214. As will become appreciated from subsequent portions of this disclosure, protrusions 218 serve to space the ejector 200 from an adjacent cutting rule mounted on a die board. That is, the rubber ejector 200 is disposed adjacent a cutting rule such that the protrusions 218 project out and engage the side of the cutting rule. This automatically spaces the main body of the ejector 200 from the cutting rule.

Referring back to the lugs 208 and the respective voids or relief areas 210, it is seen in the drawings where each lug includes a pair of sides 208*a* and 208*b* that extend from the top 208*a* towards the central body 206 of the ejector 200. In the embodiment disclosed, the sides 208*a* and 208*b* are angled downwardly from the top of lug 208 (see FIGS. 2 and 3). Extending between the sides 208*a* and 208*b* is an indented surface 220. Consequently, the voids or relief areas 210 are defined or bounded by the pair of the opposed sides 208*a* and 208*b* and the indented surface 220.

Figure 5:
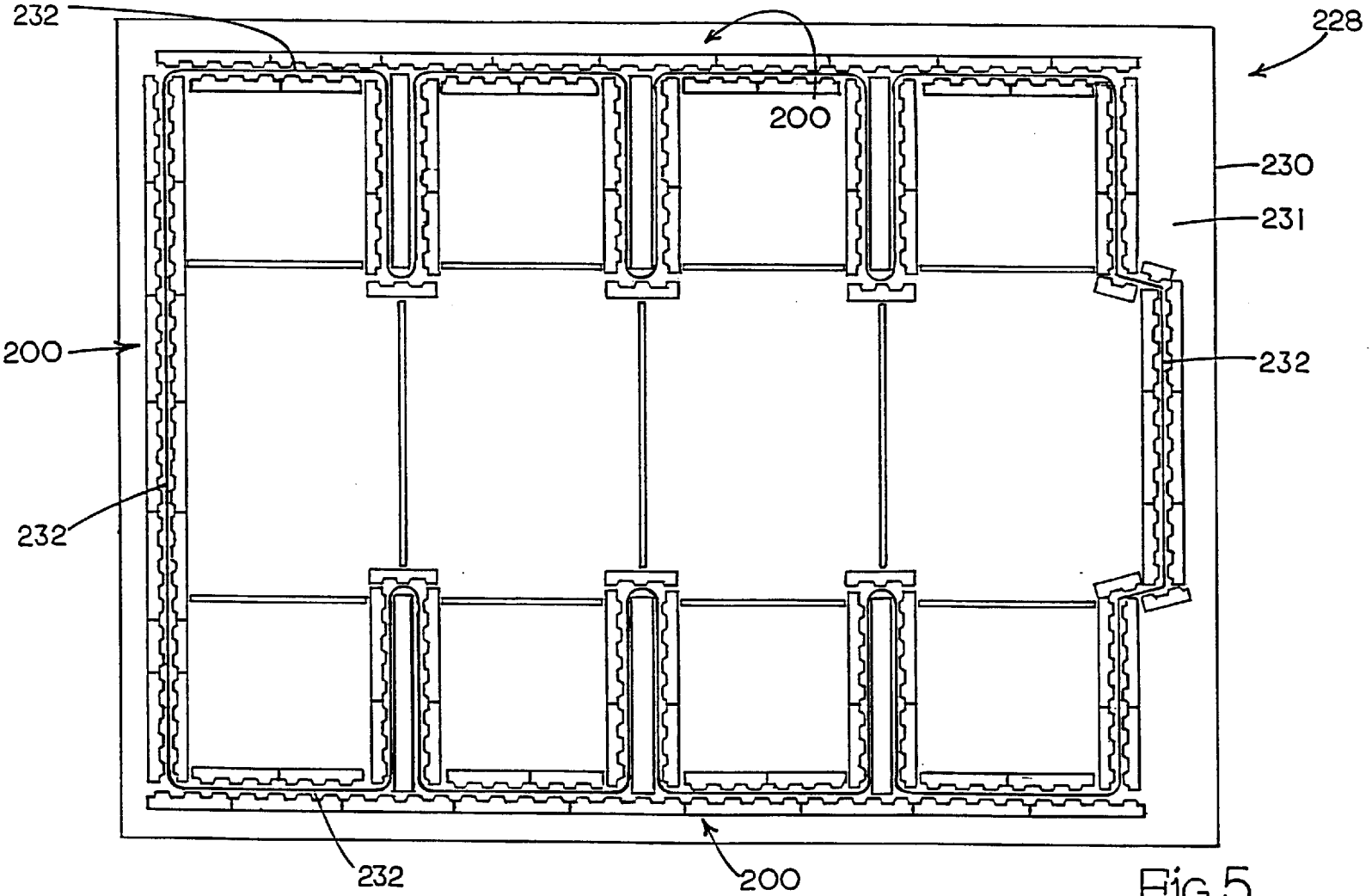
FIG. 5 is a top plan view of a cutting die having a series of ejector strips incorporated therein.
Figure 8:
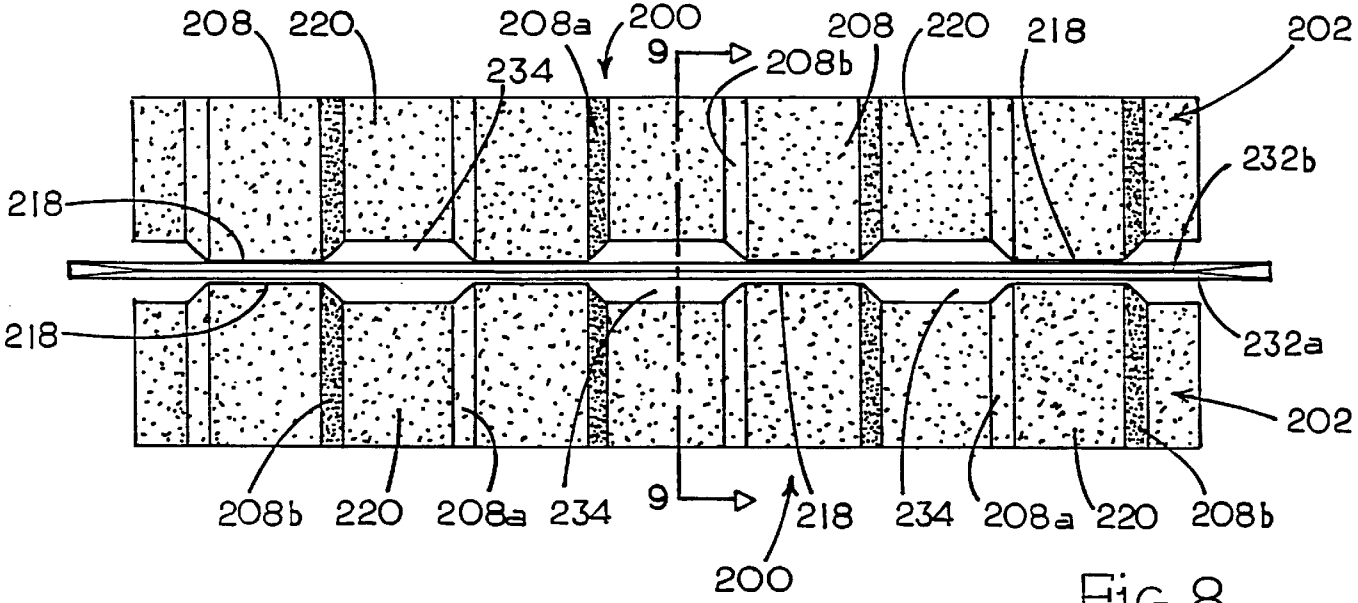
FIG. 8 is a top plan view showing the relationship of a pair of ejector strips to a cutting rule structure.
Figure 9:
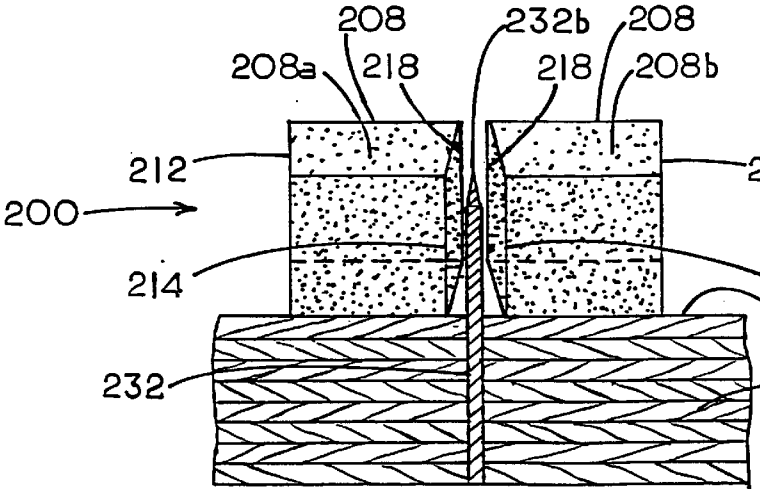
FIG. 9 is a transverse cross-sectional view of FIG. 8.

Turning to FIG. 5, the rubber ejector 200 is mounted on a cutting die indicated generally by the numeral 228. Cutting die 228 includes a die board 230 that in turn includes an outer or upper surface 231. One or more slits or grooves are formed in the die board for receiving and supporting a cutting rule structure 232 that is typically made up of a series of cutting rules that extend about the surface 231 of the die board 230. As seen in the drawings (FIGS. 6 and 8), the cutting rule structure 232 includes an upper beveled surface 232*a* and a cutting edge 232*b*. Secured to the die board 230 adjacent the cutting rule structure 232 is the rubber ejector 200. In the embodiment illustrated, the rubber ejector 200 extends along opposite sides of the cutting rule structure 232. The rubber ejector may be provided in various forms and sizes. It is contemplated that the rubber ejector 200 will be molded in a sheet form and then cut into strips. The length, width and size of the strips may vary but in the way of an example, the strips may be approximately 3 to 5 inches long and glued onto the die board 230 in end-to-end relationship (FIG. 5). As illustrated in the drawings, the strips of the rubber ejector 200 are spaced slightly away from the cutting rule structure 232. This is achieved by abutting the outward terminal ends of the protrusions 218 directly against the cutting rule structure 232. Because the protrusions 218 abut against the cutting rule structure 232, a series of spaces 234 (FIG. 8) are formed between the respective ejectors 200 and the cutting rule structure.

To secure the rubber ejector strips to the die board 230, glue is applied to the die board and/or the lower face 204 of the rubber ejector strips. Thus, the lower face 204 of the ejector 200 is glued directly to the die board 230.

Figure 6:
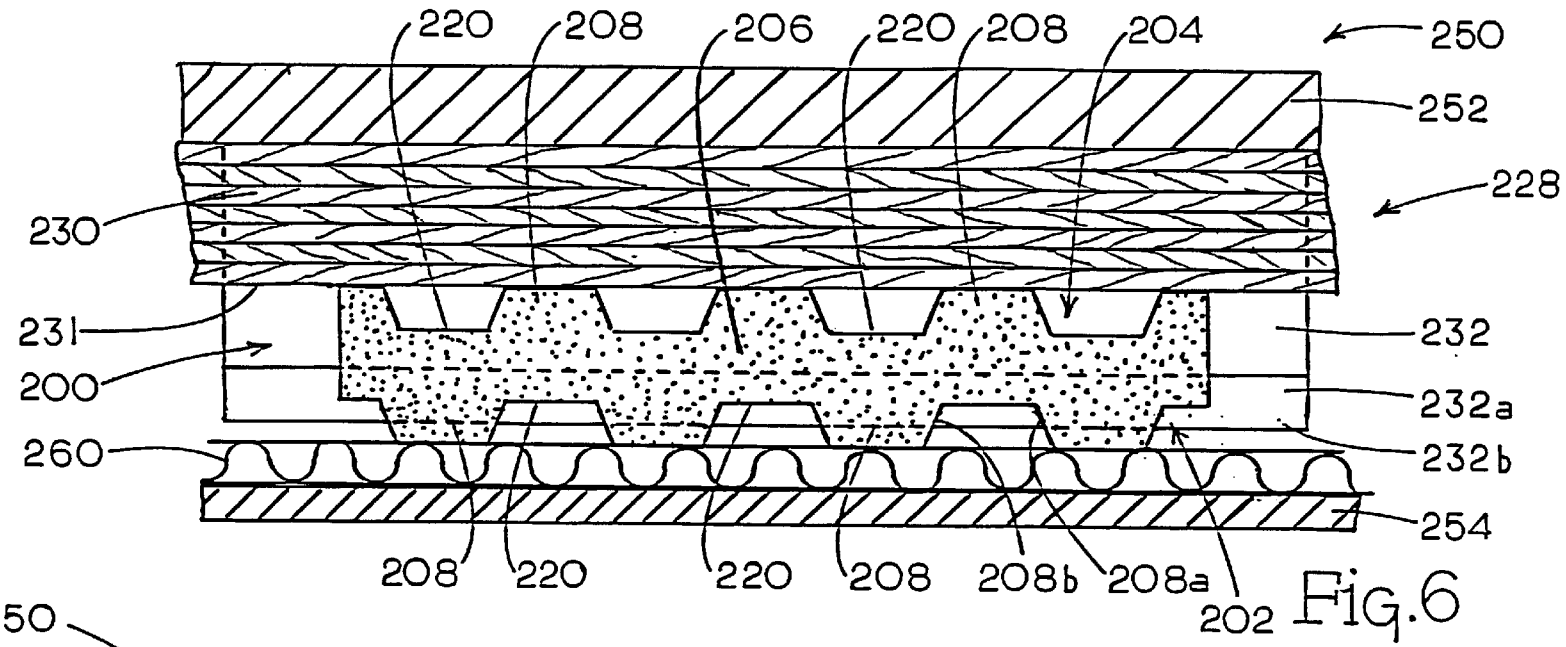
FIG. 6 is a schematic cross-sectional illustration showing the ejector strip of the present invention incorporated into a cutting die and assuming an expanded or non-compressed state.

Once glued in place, the lugs 208 extending from the upper face 202 extend above or beyond the cutting edge 232*b* of the cutting rule structure 232. See FIG. 6. That is, the overall height of the ejector 200 relative to the surface 231 of the die board 230 is greater than the height of the cutting rule structure 232 relative to the same surface 231. The distance that the lugs 208 extend above the cutting edge 232*b* can vary. It is contemplated that in one embodiment of the present invention that the lugs 208 would extend approximately 0.125 inches above the cutting edge 232*b*. Also, as seen in FIG. 6, the indented surface of the ejector 200 extending between the lugs 208 lies below the height of the cutting edge 232*b*. This distance can also vary depending upon the circumstances and conditions surrounding the corrugated board to be cut and ejected. But in one embodiment, it is contemplated that the distance between the cutting edge 232*b* and the indented surface 220 will be approximately 0.030 inches. This of course means that the central axis of the rubber ejector 200 lies below the height of the cutting edge 232*b*.

The cutting die 228 and the ejector 200 thereof can be installed in various die cutting machines including, but not limited to, rotary die cutters and reciprocating platen die cutters. Rotary die cutting machines and reciprocating platen die cutting machines are well-known and appreciated by those skilled in the art. Accordingly, details of these die cutting machines will not be dealt with herein.

Figure 7:
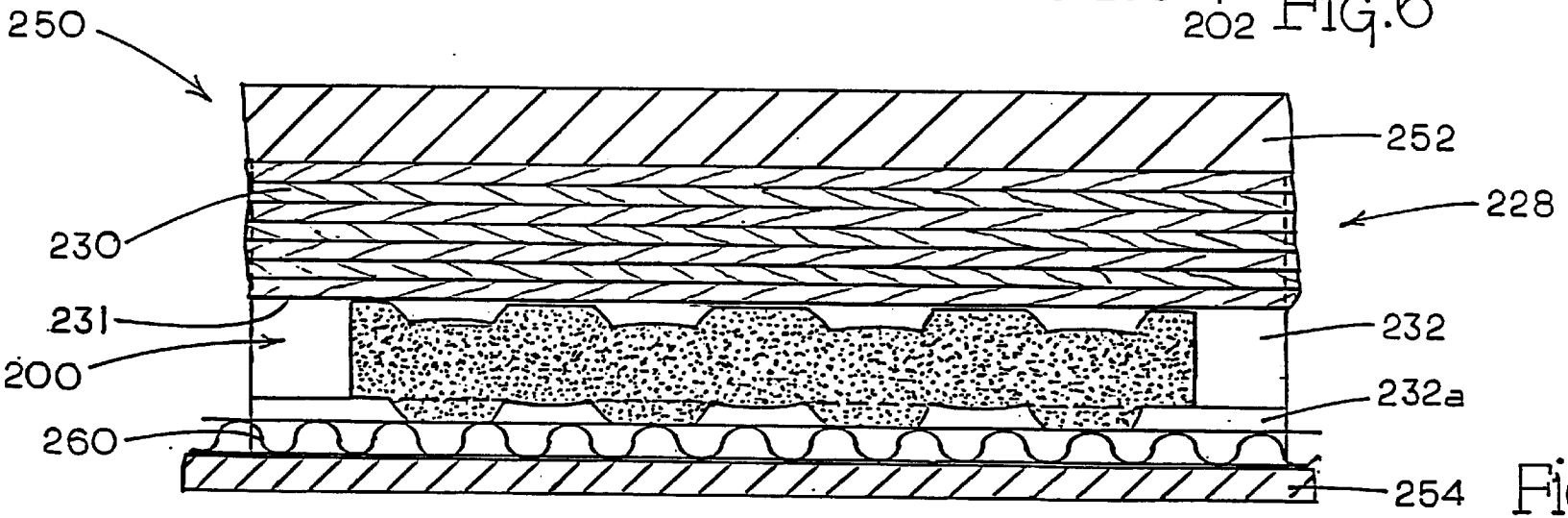
FIG. 7 is a view similar to FIG. 6 but with the cutting die disposed in a closed position and with the ejector strip shown assuming a compressed state.

For purposes of reference and illustration, the schematic illustrations of FIGS. 6 and 7, show the cutting die 228 and the ejector 200 thereof being installed into a reciprocating platen die cutting arrangement indicated generally by the numeral 250. This reciprocating platen die cutting device includes an upper plate 252 and an opposed plate or anvil (support structure) 254. The cutting die 228 discussed above is installed in the reciprocating platen die machine 250 by securing the cutting die 228 to the upper plate 252. In the cutting and ejection process, panels of corrugated board 260 are transferred between the cutting die 228 and the lower anvil or plate 254. Thereafter, pressure or force is applied to one of the plates 252 and 254 causing the cutting die 228 and the opposed plate 254 to come together such that the cutting die 228 engages the corrugated board 260 disposed therebetween. In this process, the cutting rule structure 232 engages and cuts the corrugated board 260. As seen in the drawings, once the cutting rule structure starts to penetrate the corrugated board 260, the rubber ejector strips 200 start to compress as they are effectively compressed between the die board 230 and the corrugated board 260. During this compression, the lugs 208 that project from the ejector 200 are compressed inwardly toward the main body 206 of the ejector 200. As the lugs 208 are compressed, it is seen that portions of the rubber ejector tend to fill the voids or relief areas 210. In the fully compressed position shown in FIG. 7, the voids or relief areas 210 have been filled and the lugs 208 on both the upper and lower faces 202 and 204 have effectively lost their definition and have been compressed into the central portion of the compressed ejector 200.

One of the principal aims of the present invention is to provide an ejector design that will eliminate or substantially eliminate flute crushing during the die cutting operation. FIG. 7 illustrates the die cutter 250 in a closed position. Here, the distance between the cutting die 228 and the lower anvil 254 is at a minimum. Note that the ejector 200 is fully compressed but that the corrugated board 260 is not compressed and the flutes thereof are not crushed. This is because the resilient pressure of the ejector 200 when compressed to this state is insufficient to overcome the strength of the flutes and to crush the same. Once the cutting die 228 is opened by basically separating the cutting die 228 from the anvil plate 254, then the rubber ejector strips 200 expand to their normal non-compressed state. Since the cut corrugated board tends to be retained on the cutting die 228 and particularly on the cutting rule structure 232, the expansion of the ejector strips 200 results in the strips engaging and pushing the cut corrugated board from the cutting die 228 and its cutting rule structure 232. The term "engage", "engagement", or "engaging", as those terms are referred to herein, mean that the corrugated board is engaged either directly or indirectly. This is because in practice, it may be advisable and advantageous to interpose a sheet-like material between the upper face 202 of ejector 200 and the corrugated board being cut and ejected.

Thus, it is important that the ejector 200 be designed and configured such that in a fully compressed position the ejector will not crush the flutes that form a part of the corrugated board 260. At the same time the rubber ejector must be sufficiently resilient to eject the cut corrugated board from the cutting die 228 and its cutting rule structure once the cutting die assumes an open position.

To facilitate ejection of the corrugated board, it may be preferable to provide a substantial taper 238*a* to the cutting rule structure 232. It follows that the cut corrugated board would be easier to eject from the cutting rule structure if the thickness of the corrugated board is not greater or is not substantially greater than the length of the taper 232*a*. In the embodiment illustrated herein, the cutting rule structure is selected or designed to possess a taper having a length of approximately 0.125 inches. This is one example of a taper but it will appreciate that other taper lengths may be utilized.

Finally, the rubber ejector 200 is formed of a closed cell rubber having durometer (based on the Shore 00 scale) of approximately 60–78 and a density of 10 to 30 lbs. per cubic foot. Other densities and durometers may be appropriate in certain situations. In one example, the rubber ejector 200 was constructed of a closed cell rubber having a Shore 00 durometer of 65 and a density of 19 lbs. per cubic foot.

From the foregoing discussion, it is appreciated that the ejector 200 of the present invention is designed such that the structure thereof will effectively and efficiently eject cut corrugated board from a cutting die but at the same time will eliminate or substantially reduce flute crushing when the same is compressed during a die cutting operation. Because of the properties and characteristics of the ejector 200 of the present invention, the overall force or tonnage required to operate the cutting die having the ejector 200 incorporated therein is substantially reduced. That in turn reduces the wear and tear on the cutting die and its components and accordingly, the life of the cutting die is extended.

In the discussion above, the specification has dealt with an ejector for ejecting cut corrugated board from a cutting die. However, it will be appreciated that ejectors can also be used to eject scrap from a cutting die. In that regard, this specification will now deal with the scrap ejector that is shown in FIGS. 9–17.

Figure 10:
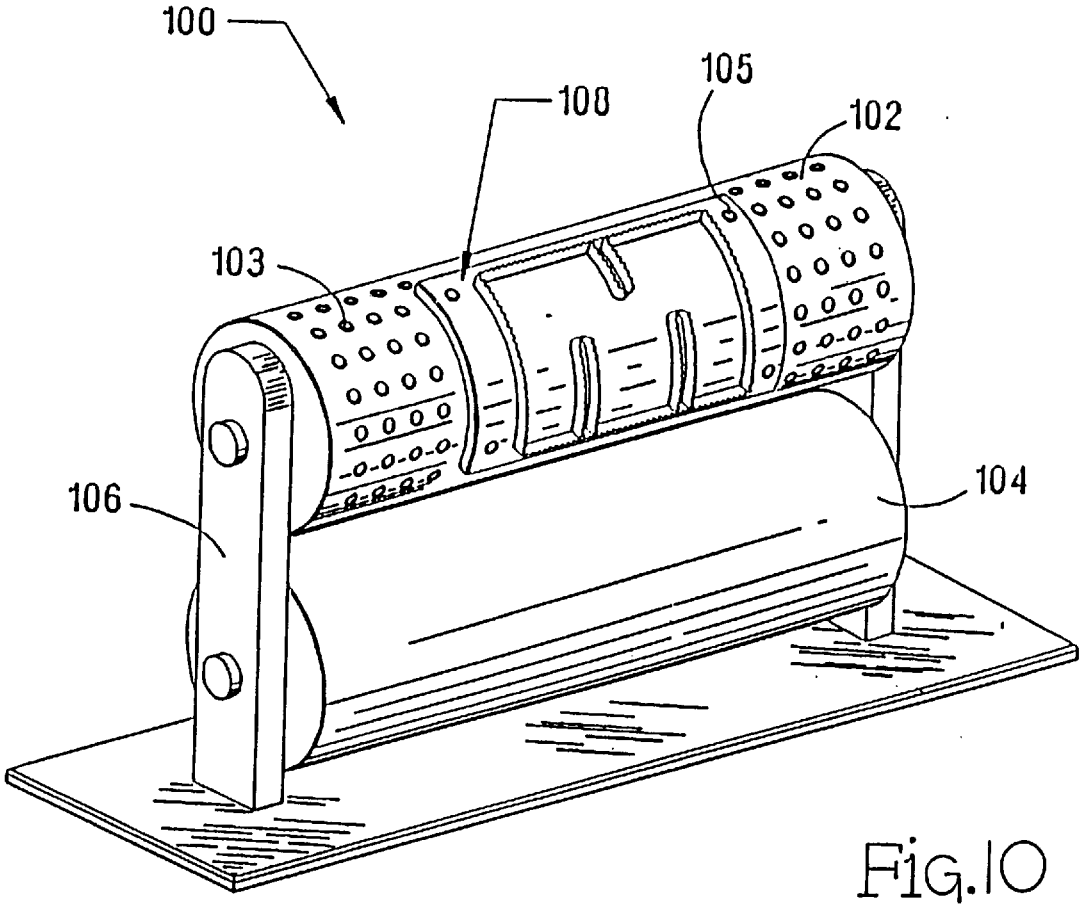
FIG. 10 is a schematic view in perspective of a rotary die machine.

Referring particularly to FIG. 10, a rotary die cutter is shown therein and indicated generally by the numeral 100. Rotary die cutter 100 includes an upper die roll 102 and a lower anvil roll 104 which are rotatively mounted in a frame 106 in parallel spaced relationship. The die roll 102 and anvil roll 104 are typically driven by suitable drive means (not shown) in opposite directions and a sheet of material, particularly corrugated board, is fed between the rolls 102 and 104.

Figure 11:
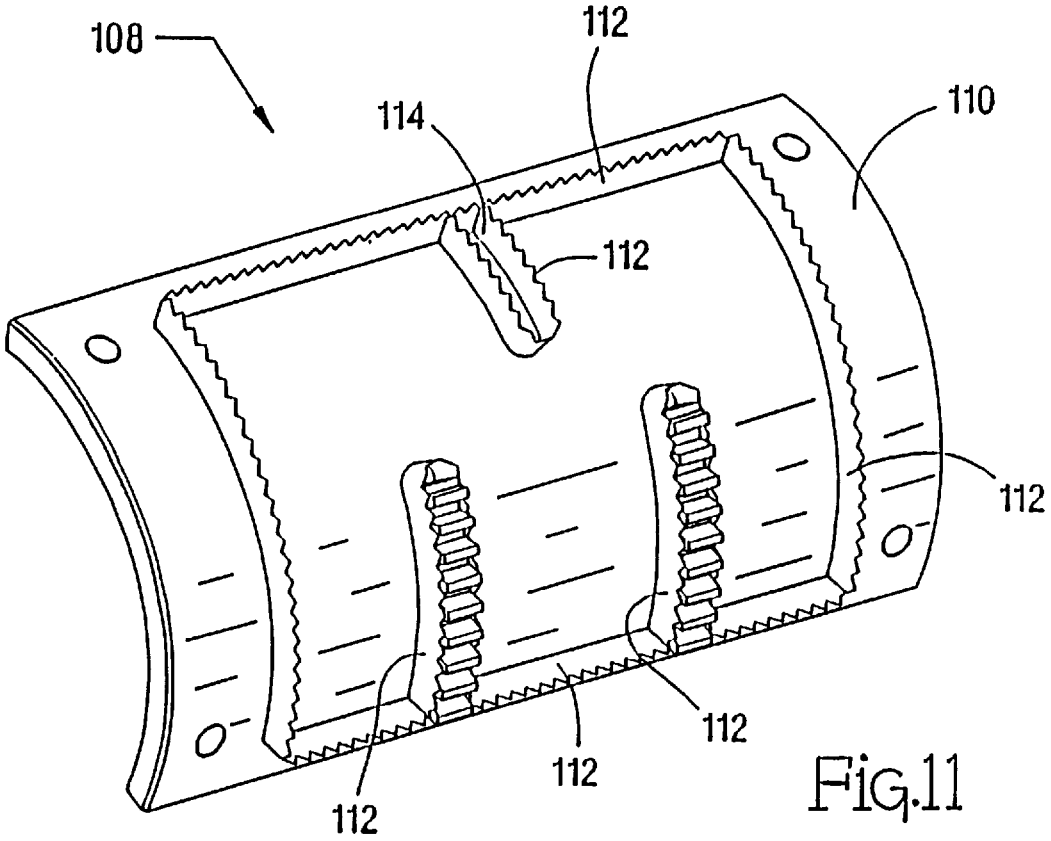
FIG. 11 is a perspective view of a cutting die.

Anvil roll 104 typically consists of a metal cylinder having a resilient layer made up of urethane or other suitable material. Die roll 102 also includes a metal cylinder which has a plurality of threaded bores 103 arranged in parallel rows. A cutting die, indicated generally at 108, is fixed to the core of the die roll 102 by threaded fasteners 105 that screw into the threaded bores 103 of the die roll 102. Referring to FIG. 11, there is shown a perspective view of a cutting die 108. Cutting die 108 includes a die board 110 having steel cutting rules 112 projecting therefrom. Other types of rules, such as creasing rules or perforating rules, are also commonly used but are not shown in this figure. Die board 110 is usually made from a high quality plywood, such as maple, formed into an arcuate shape. Cutting rules 112 are inserted into saw cuts made in the die board 110. When producing a blank for a corrugated box, carton or container, it is common to produce slots or flaps or tabs. To form the slot, cutting rule 112 is bent into a U-shaped configuration as shown in FIG. 11. A cavity or recess 114 is thus formed between the sides of the U-shaped cutting rule 112. The scrap severed from the corrugated paper board is received in the cavity or recess 114 when the cutting die 108 is moved into contact with the corrugated paper board. It is necessary to eject this scrap as the cutting die 108 moves out of contact with the corrugated board to prevent the scrap from clogging the cutting die 108 and rendering it inoperative.

Figure 12:
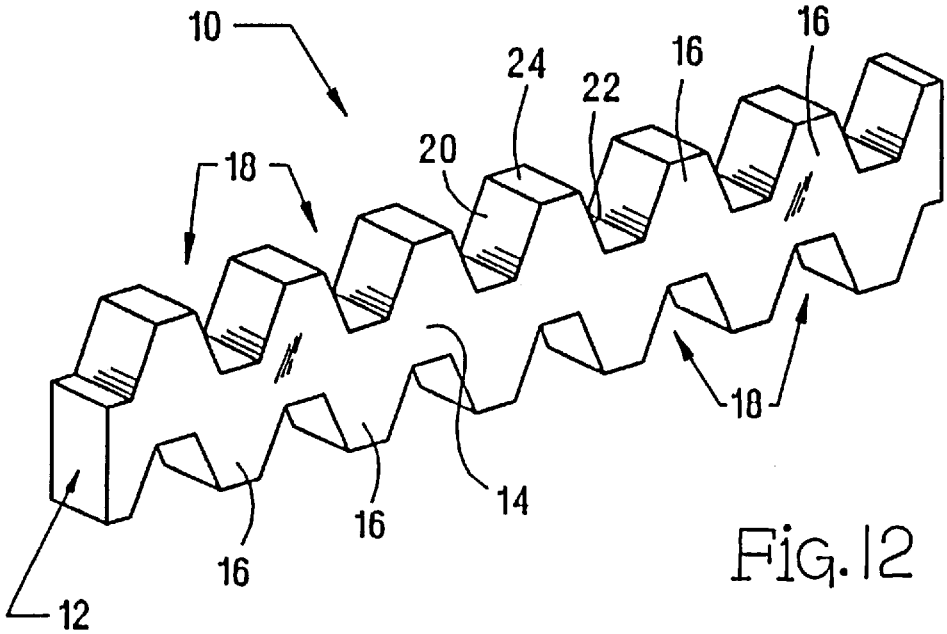
FIG. 12 is a perspective view of an ejector for ejecting scrap.
Figure 13:
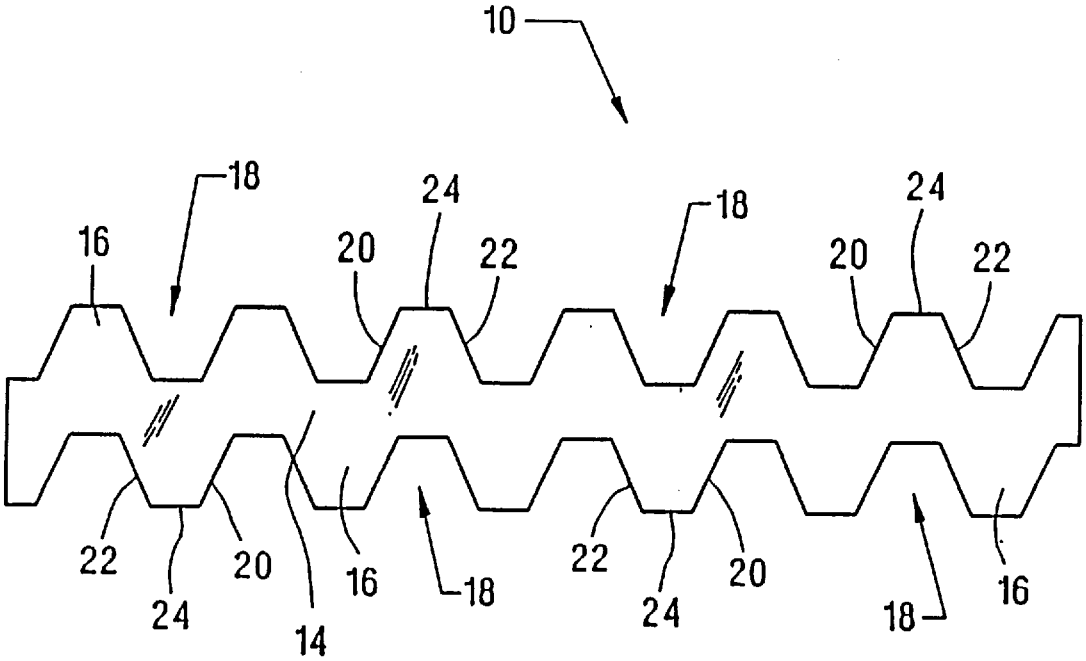
FIG. 13 is a longitudinal elevational view of the scrap ejector.
Figure 14:
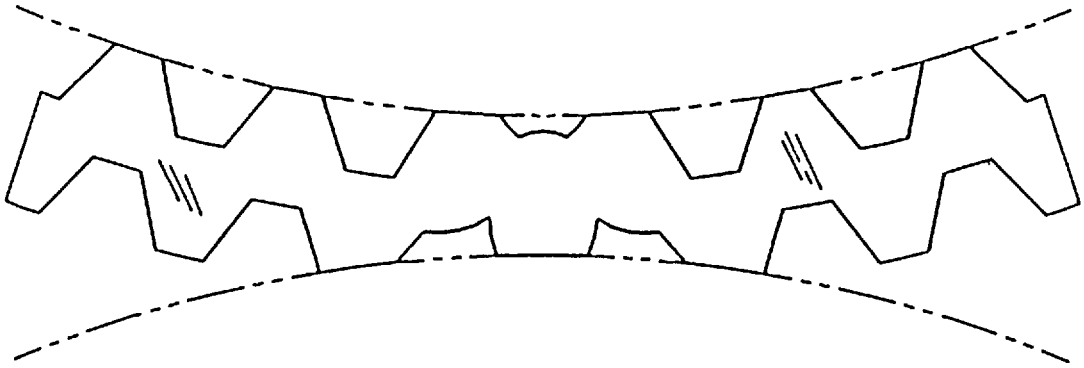
FIG. 14 is a longitudinal elevational view of the scrap ejector showing a compressive force applied to a portion thereof.
Figure 15:
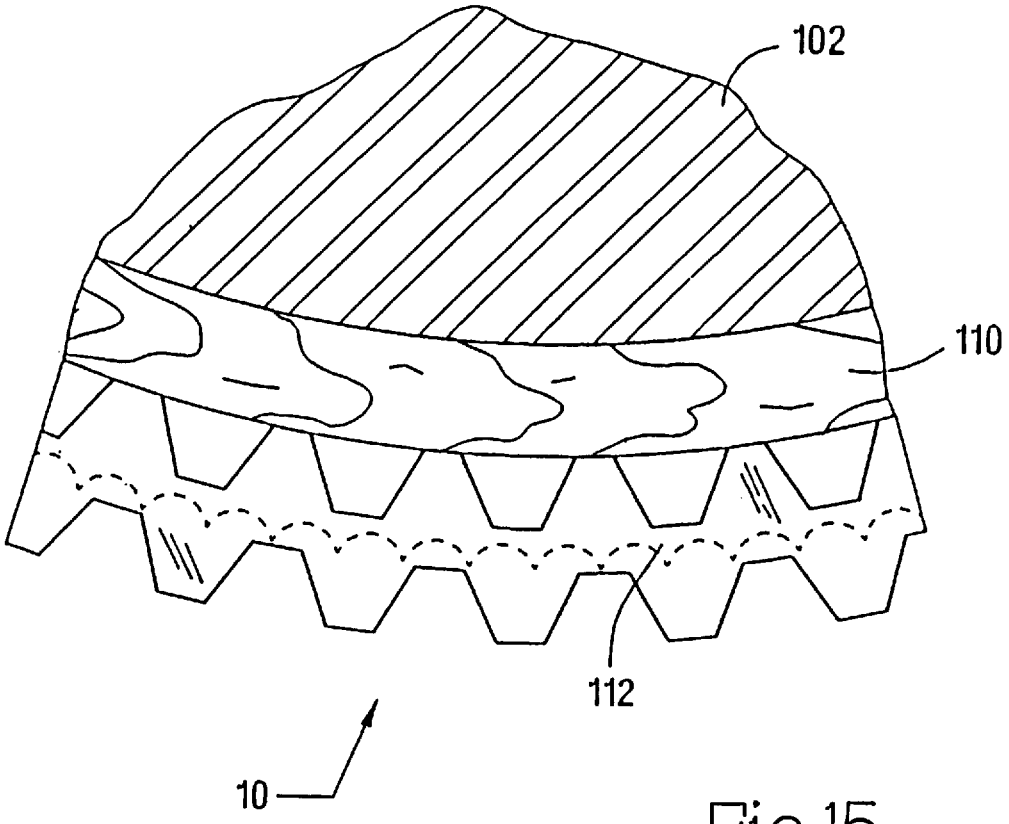
FIG. 15 is a fragmentary section view of a die cylinder showing a die board, cutting rule and the scrap ejector.

To eject and strip scrap from the recess or cavity 114 in the cutting die 108, a resilient, scrap ejector 10 of the present invention is placed within the recess or cavity 114. The scrap ejector 10 is preferably made of a closed cell, high density foam rubber having a durometer of 70 to 90 on the Shore 00 scale. As shown in FIGS. 12 and 13, the scrap ejector 10 comprises an elongated body 12 having a longitudinal extending web 14. A plurality of lugs or compressive elements 16 project from the top and bottom faces of the web 14. The lugs or compressive elements 16 are separated by relief areas or notches 18.

Each of the lugs 16 include a pair of side walls 20 and 22 which extend outwardly from the web 14 to an outer face 24. In the preferred embodiment, the lugs 16 are of uniform height and the outer faces 24 of the lugs 16 define first and second contact surfaces.

In the embodiment shown in FIG. 12, the lugs 16 are staggered on opposite sides of the web 14. Thus, each lug 16 is disposed opposite a corresponding relief area 18 on the opposite side of the web 14. When a compressive force is applied to the lug 16 as shown in FIG. 13, the lug 16 is subjected to both compression and displacement into the opposing relief area notch 18. Thus, the notches or relief areas 18 provide a displacement zone for the elongated body 12 when the scrap ejector is subjected to compressive forces. In use, the scrap ejector 10 of the present invention is secured within a recess or cavity 114 on the cutting die 108 as shown in FIG. 6. The outer faces 24 of the lugs 16 on one side of the web 14 are secured by a suitable adhesive to the die board 108. The lugs 16 on opposite sides of the web 14 extend above the edge of the cutting rule 112. The height of the scrap ejector 10 is such that the outer faces 24 extend beyond the cutting edges of the cutting rule 112 to assure proper ejection of the scrap. When the scrap ejector is compressed as the die moves into contact with the corrugated paper board, the scrap ejector 10 is easily deformed. Lugs 16 become compressed and are displaced into the relief areas 18. By allowing room for displacement for the lugs 16, the present invention avoids the problem of overloading and permanently deforming the scrap ejector 10. As scrap ejector 10 passes through the rotary die it holds the scrap against the anvil cylinder 104 so that the scrap is stripped from the blank.

In prior art scrap ejectors, the ejector may be compressed to approximately 50% of its original height without damaging the rubber. Since the present invention provides a displacement zone for the rubber, the scrap ejector 10 can be compressed to approximately 30% of its original height without damage so that a taller ejector can be used. Further, since the rubber is displaced, the individual cells of the rubber are compressed to a lesser extent than in prior art scrap ejectors. As a result, the useful life of the ejector is increased.

Figure 16:
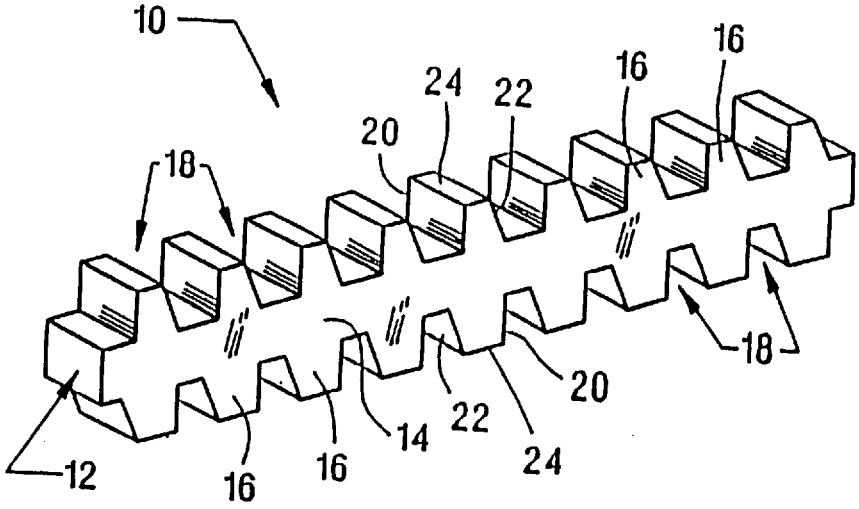
FIG. 16 is a perspective view showing a second embodiment of the scrap ejector.
Figure 17:
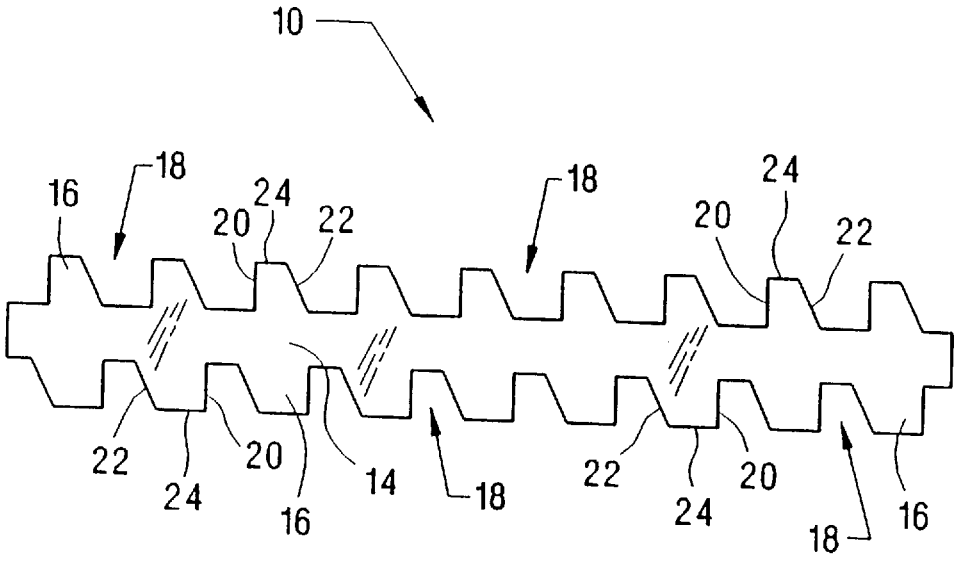
FIG. 17 is a longitudinal elevational view showing the embodiment of FIG. 16.
Figure 18:
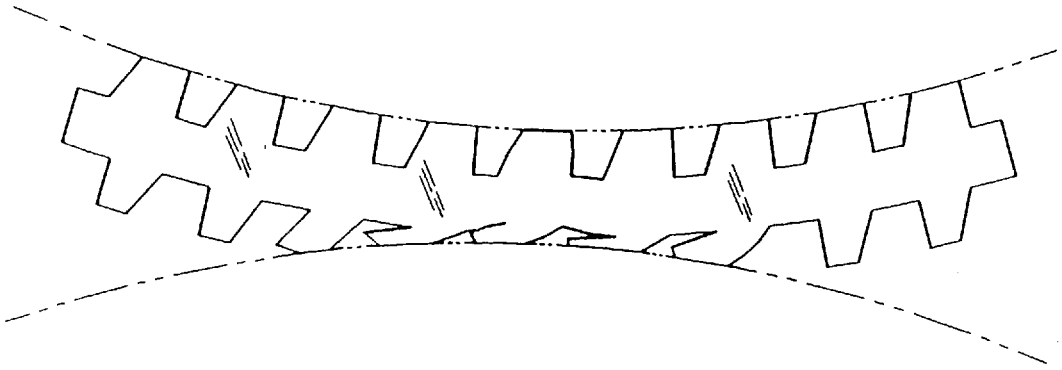
FIG. 18 is a longitudinal elevational view showing the embodiment of FIG. 16 being subjected to a compressive force.

Referring to FIGS. 16 and 17, a second embodiment of the scrap ejector is shown. In the embodiment of FIG. 16, lugs 16 are disposed opposite one another on each side of the web 14 rather than being staggered. The lugs 16 on the top of the web 14 (as seen in FIG. 17) are slightly smaller than the lugs 16 on the bottom of the web 14. Further, the lugs 16 include one side wall 20 which is perpendicular to the web 14 and another side wall 22 which forms an oblique angle with the web 14. When a compressive force is applied to one of the lugs 16, as shown in FIG. 18, the lugs 16 roll into adjacent relief areas or notches 18 on the same side of the web 14 as they squeeze between the cylinders. That is, the lugs bend in a direction parallel to the longitudinal axis of the scrap ejector 10. Thus, when the scrap ejector 10 returns to its original condition, it will apply a longitudinally directed force to the scrap severed from the corrugated paper board. This longitudinal compression of the force helps to free the scrap from the slot formed in the carton blank.

In both embodiments described and shown in FIGS. 10–18, the lugs 16 and notches 18 on one side of the web 14 are complimentary to the lugs and notches on the opposite side of the web. Thus, the scrap ejector 10 can be nested together. By using complimentary shapes for the lugs 16 and notches 18, a greater number of scrap ejectors 10 can be produced from a given amount of stock material thereby increasing the yield and lowering cost of producing the scrap ejectors 10.

Based on the foregoing, it will be seen that the scrap ejector 10 according to the present invention, through its geometric form, provide sufficient space in the cutting rule cavities to allow for deformation of the rubber. By allowing displacement of the rubber, the height of the scrap ejector can be increased without overloading and permanently deforming the ejector. The increased height of the ejector will result in improved performance.

Various modifications of the above described embodiments will be apparent to those skilled in the art. For example, circular or oval shaped openings can be formed in the rubber strip between the upper and lower faces to provide void areas for displacement of the rubber.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

We claim:

1. A cutting die for cutting and ejecting corrugated board comprising;

(a) a die board;

(b) a cutting rule supported by the die board and extending outwardly from the surface thereof; and (c) an ejector supported on the die board for ejecting cut corrugated board from the die board;

(d) the ejector being vertically oriented on the die board and including an upper surface for engaging the corrugated board and a lower surface disposed below the upper surface and supported on the die board;

(e) wherein the upper and lower surfaces includes a series of space apart lugs and a series of space apart relief areas for permitting one or more of the lugs to move towards one or more of the relief areas and causing the one or more relief areas to be at least partially filled in response to the ejector being compressed between the die board and the corrugated board;

(f) wherein the lugs and relief areas of the upper surface are staggered with respect to the lugs and relief areas of the lower surface; and (g) wherein the ejector further includes a pair of sides with one side including a series of spaced apart protrusions that extend outwardly from the ejector.

2. The cutting die of claim 1 wherein the ejector is formed of rubber.

3. The cutting die of claim 2 wherein the durometer of the rubber ejector is in the range of approximately 60 to 78.

4. The cutting die of claim 3 wherein the density of the rubber ejector is in the range of approximately 10 to 30 lbs. per cubic foot.

* * * * *